US007284511B2

(12) United States Patent
Zahner et al.

(10) Patent No.: US 7,284,511 B2
(45) Date of Patent: Oct. 23, 2007

(54) COMBUSTION-ENGINED SETTING TOOL

(75) Inventors: Mario Zahner, Chur (CH); Peter Stauss, Feldkirch (AT); Rolf Erhardt, Buchs (CH)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 11/591,045

(22) Filed: Oct. 31, 2006

(65) Prior Publication Data

US 2007/0101954 A1 May 10, 2007

(30) Foreign Application Priority Data

Nov. 4, 2005 (DE) ..... 10 2005 000 149

(51) Int. Cl.
*F02B 71/04* (2006.01)
*F02B 71/00* (2006.01)

(52) U.S. Cl. ..... 123/46 H; 123/46 SC; 123/46 R; 227/9; 227/10; 173/209

(58) Field of Classification Search ..... 123/46 R, 123/46 SC, 46 H, 198 D; 227/9, 10; 173/209
See application file for complete search history.

(56) References Cited

U.S. PATENT DOCUMENTS 3,964,659 A 6/1976 Eiben et al.
4,074,844 A * 2/1978 Hodil, Jr. ..... 227/8
4,298,072 A 11/1981 Baker et al.
4,679,719 A 7/1987 Kramer
5,909,836 A 6/1999 Shkolnikov et al.
6,532,917 B2 * 3/2003 Thieleke et al. ..... 123/46 SC
6,666,366 B2 * 12/2003 Rosenbaum et al. ..... 227/8
7,168,603 B1 * 1/2007 Lund et al. ..... 227/10

FOREIGN PATENT DOCUMENTS

EP 1512495 3/2005

* cited by examiner

*Primary Examiner*—Stephen K. Cronin
*Assistant Examiner*—Ka Chun Leung
(74) *Attorney, Agent, or Firm*—Abelman, Frayne & Schwab

(57) ABSTRACT

A combustion-engined setting tool for driving fastening elements in a constructional component end including a combustion chamber (13) for combusting a gas mixture, an inlet/outlet device (40) for opening the combustion chamber (13) in its first position and for closing the combustion chamber (13) in its second position and having a valve element for reversibly displacing the inlet/outlet device (40) between its first and second positions, a locking element (37) for locking the valve element of the inlet/outlet device (40) in the second position of the device, a trigger (30) for actuating the locking element (37), a release switch (22) for triggering ignition in the combustion chamber (13), an electronic control unit (20) for controlling start of the ignition in the combustion chamber (13), and an initialization switch connected with the control unit (20), the control unit (20) initiating the ignition in the combustion chamber (13) when a time period between switching-on of the initialization switch and switching-on of the release switch (22), which is also connected with the control unit, does not exceed a predetermined set time period.

5 Claims, 5 Drawing Sheets

COMBUSTION-ENGINED SETTING TOOL

BACKGROUND OF THE INVENTION

1. Field of the Invention

The present invention relates to a combustion-engined setting tool for driving fastening elements such as nails, bolts, or pins in a constructional component and including a combustion chamber for combusting a gas mixture, an inlet-outlet device having a first position in which it opens the combustion chamber, a second position in which it closes the combustion chamber, with the inlet/outlet device having valve means for reversibly displacing the inlet/outlet device between its first and second positions, locking means for locking the valve means of the inlet/outlet device in the second position of the device, a trigger for actuating the locking means, and a release switch for triggering ignition in the combustion chamber.

2. Description of the Prior Art

Setting tools of the type described above have a combustion chamber in which a portion of a liquefied gas or any other evaporated fuel is combusted together with oxidation means such as, e.g., environmental air.

The combustion energy drives a setting piston, which is displaceable in a piston guide, for driving a fastening element in a constructional component. After completion of a setting process, the setting piston is displaced back into its initial position adjacent to the combustion chamber. In combustion-engined setting tools of the type discussed above, with a thermal return of the setting piston, the combustion chamber should be locked until the setting piston is returned to its initial position. This locking is effected with mechanical means which is connected to a trigger.

A combustion-engined tool of a type described above is disclosed in U.S. Pat. No. 5,909,836. The tool includes a combustion chamber and an adjoining it, piston guide in which a setting piston is displaceable. In the axial direction, the combustion chamber is limited, on one hand, by the setting piston and, on the other hand, by a cylinder head. A displaceable sleeve forms sidewalls of the combustion chamber and simultaneously functions as valve means that cooperates with the cylinder head and that closes or opens aeration openings of the combustion chamber. The sleeve is connected with a press-on feeler and is displaced therewith in an axial direction when the setting tool is pressed against a constructional component. Upon actuation of a trigger which is provided on the setting tool, a release switch is closed and an electrical spark is produced. The electrical spark ignites a gas mixture that fills the chamber, e.g., an air-fuel mixture, whereby a combustion process is initiated. The setting piston is accelerated and drives a fastening element in the constructional component. The return movement of the setting piston in its initial position takes place as a result of vacuum which is produced in the combustion chamber after the combustion process ends. The combustion chamber should remain locked until the setting piston is displaced completely in its initial position. To this end, the sleeve or the valve means that closes the combustion chamber, is locked by the actuated trigger before the release switch initiates the ignition. In order to insure that the combustion chamber does not open too rapidly after actuation of the trigger, U.S. Pat. No. 5,909,836 provides for retardation of the trigger movement which causes the release of the sleeve or the valve means.

The drawback of the setting tool of U.S. Pat. No. 5,909,836 consists in that it is possible to press the setting tool against a constructional component, to lock the valve means with the trigger, without actuating the setting tool, and to lift the setting tool off the constructional component with the setting tool being actuated by a further displacement of the trigger.

Accordingly, an object of the present invention is to provide a setting tool of the above-described type with which actuation of the setting tool in a lift-off condition, with the combustion chamber being closed or sealed, is not possible.

SUMMARY OF THE INVENTION

This and other objects of the present invention, which will become apparent hereinafter, are achieved by providing in the setting tool described above, an electronic control unit for controlling start of the ignition in the combustion chamber with the release switch being connected with the control unit, and an initialization switch connected with the control unit and which is actuated before locking of the valve means. The control unit initializes the ignition in the combustion chamber only then when a time period between switching-on of the initialization switch and switching-on of the release switch does not exceed a predetermined set time period.

Thereby, it is prevented that the setting tool can be actuated, when it is pressed against a constructional component and is locked, by a partial actuation of the trigger. The time window defined by the set time period for actuation of the ignition is very short, such that it provides for a normal pulling of the trigger for locking the inlet/outlet device and for actuation of the ignition by the trigger, directly or indirectly with the release switch that is actuated by the trigger, but prevents a delayed actuation after lifting-off the setting tool from the constructional component with a partially actuated trigger.

Advantageously, the control unit comprises a time comparator for comparing the time period between switching-on of the initialization switch and the release switch with the set time period. Monitoring of the time period between switching-on of the initialization switch and the release switch, thus, become possible. The time comparator can, e.g., be formed by a condenser switch with the set time being determined by discharging or charging time of the switch condenser. However, the time comparator can be formed as a computer program running in a microprocessor, with the set time being input and stored in a storage unit and which is retrieved therefrom for comparison with the measured time.

Advantageously, the initialization switch is formed as a trigger switch that is switchable on, dependent on a position of the trigger. In this case, the trigger switch should not be directly actuated by the trigger, but can be indirectly actuated, e.g., by an intermediate mechanical or electronic element. This permits a direct comparison of the actual time period, which is required for a complete displacement of the trigger, with the set time period. This insures a very high degree of reliability. The set time period, preferably, lies in a range from about 300 msec to about 1,000 msec.

Alternatively, the initialization switch can be formed as a press switch that is actuated by a press-on feeler provided in a region of a bolt guide of the setting tool. In this case, the set time period should be somewhat greater because the time period for pressing a setting tool against a constructional component or a workpiece is somewhat greater.

According to a technically simple embodiment of the invention, the trigger has a switching element having a first switch arm for actuating the release switch, a second switch arm for actuating the trigger switch, and a locking member forming part of the locking means.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENT

Figure 1:
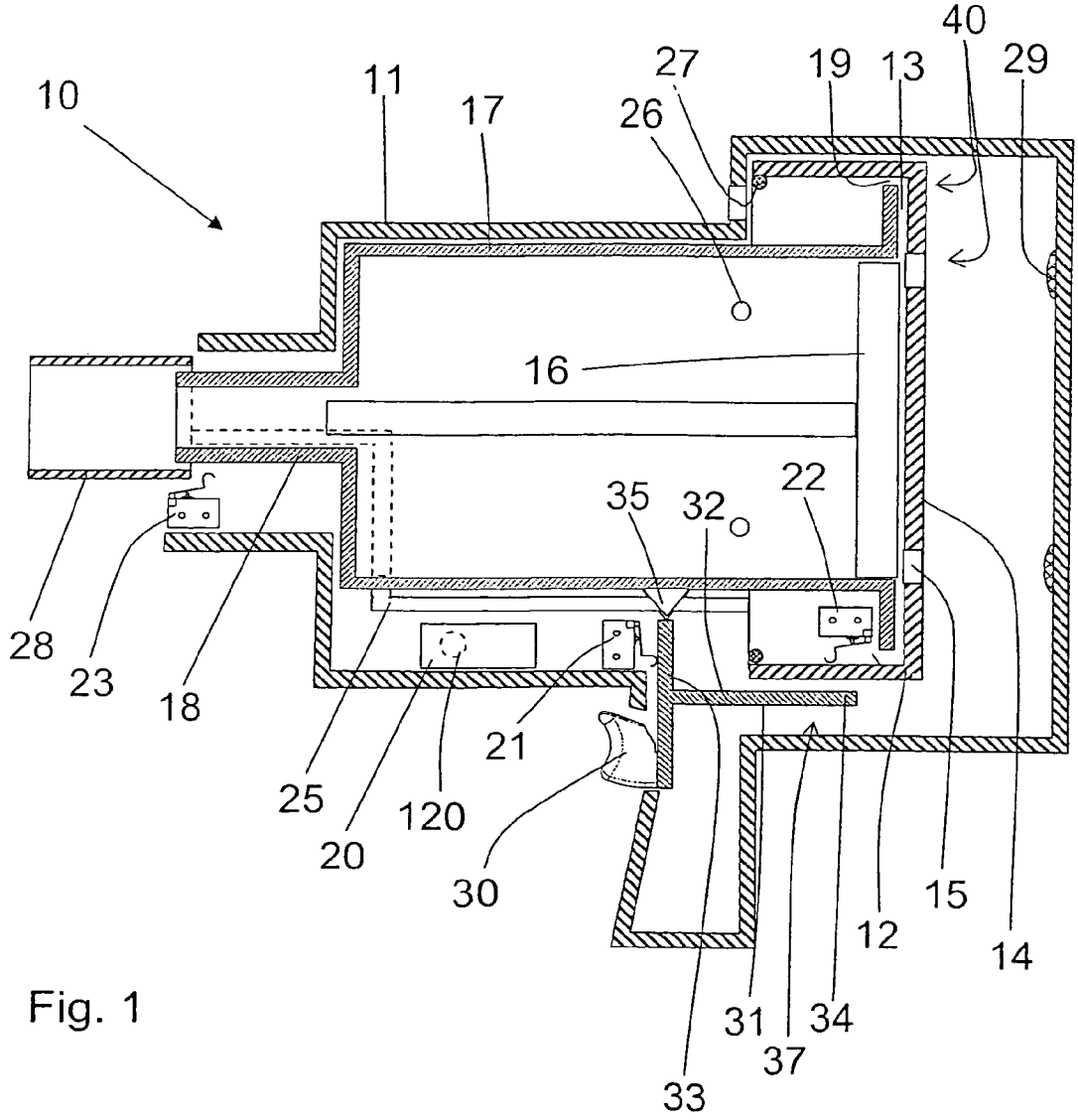
FIG. 1 a longitudinal cross-sectional view of a setting tool according to the present invention in an initial position thereof.

A hand-held combustion-engined tool 10 according to the present invention, which is shown in FIGS. 1 through 5, is driven by an evaporated liquid or gaseous fuel which is stored in a fuel reservoir, not shown.

The setting tool 10 has a housing 11 in which there is arranged a setting mechanism with which fastening elements such as nails, bolts or the like are driven in a constructional component U when the setting tool 10 is pressed against the constructional component U or another object and is actuated with a trigger 30 located on a handle 36 of the setting tool 10. The trigger 30 actuates an ignition unit, not shown in the drawings, which ignites an air-fuel mixture that fills the combustion chamber 13. The trigger 30 cooperates, via a switching element 31 such as, e.g., a rocker, with an initialization switch formed as a trigger switch 21, and a release switch 22 both of which are connected with a control unit 20 by appropriate conductors, not shown in the drawings. The switching element 31 is pivotally supported, e.g., at a pivot point 35. An electrical power source such as, e.g., one or several batteries, is also provided, but it is not shown in the drawings.

The setting mechanism includes, among others, the combustion chamber 13 expandable within combustion chamber sleeve 12, a piston guide 17 in which a setting piston 16 is displaceable, and a bolt guide 18 for guiding the fastening elements which are driven during a setting process by a movable forward, setting direction end of the setting piston 16 into the constructional component U. Preferably, the combustion chamber sleeve 12, the piston guide 17, and the bolt guide 18 are arranged coaxially with each other. At an end of the piston guide 17 adjacent to the bolt guide 18, there are provided exhaust openings 26 through which a portion of flue gases can flow out from the piston guide 17 when the setting piston 16 occupies its end position remote from the combustion chamber 13.

In the embodiment discussed here, the combustion chamber sleeve 12 is displaceably supported relative to the piston guide 17 and is resiliently biased in a direction of the bolt guide 18 or to the collapsed condition of the combustion chamber 17 by a spring, not shown in the drawings. A press-on string 25 engages, with one of its ends, an end of the combustion chamber sleeve 12, with the opposite end of the string 25 being connected with a press-on feeler 28 which is displaceably supported on the bolt guide 18 and projects beyond the bolt guide 18 in the initial position of the setting tool 10 shown in FIG. 1. The press-on feeler 28 actuates a further initialization switch which is formed as a press switch 23 which is arranged in the region of the bolt guide 18 and is connected with the control unit 20 by a conductor, not shown. The combustion chamber sleeve 12 has, at its end remote from the piston guide 17, a combustion chamber rear wall 14 and is formed as one-piece with the combustion chamber rear wall 14. However, alternatively, the combustion chamber sleeve 12 can be formed so that it is displaceable relative to the combustion chamber rear wall. In the later case, the combustion chamber rear wall 14, preferably, is fixedly connected with the setting tool housing.

Feeding of air into the combustion chamber 13 takes place through at least one first opening 15 of an inlet/outlet device 40 in the combustion chamber rear wall 14. The release of flue gases from the combustion chamber 13 takes place through at least one second opening 19 of the inlet/outlet device 40 and which is provided between the combustion chamber sleeve 12 and the combustion chamber end of the piston guide 17. In order to produce an air flow from the first opening 15 to the second opening 19 for flushing the combustion chamber 13, there can be provided, in the setting tool 10, further means such as a ventilator, not shown in the drawings. In the embodiment shown in the drawings, the inlet/outlet device 40 includes the combustion chamber sleeve 12 which functions as a valve element and which controls opening and closing of the openings 15 and 19, as it would be described further below.

FIG. 1 shows a rest or initial position of the setting tool 10 in which the combustion chamber 13 is reduced to a minimal size, and the piston head of the setting piston 16 is located at the end of the piston guide 17 adjacent to the combustion chamber 13. The press switch 23, the trigger switch 21, and the release switch 22 are not actuated by the trigger 30. The inlet/outlet device 40 occupies its first position in which the openings 15, 19 are open.

Figure 2:
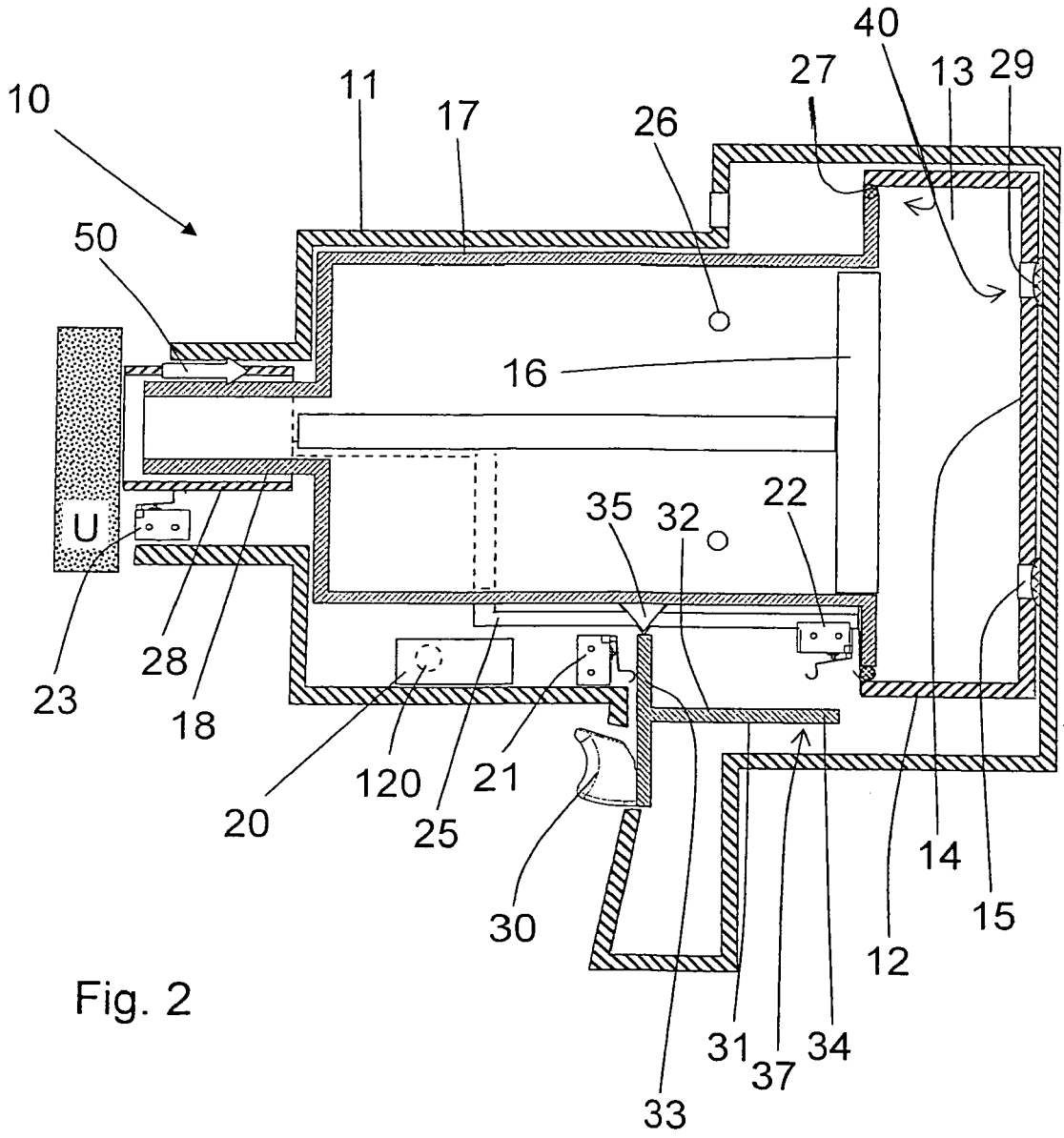
FIG. 2 a longitudinal cross-sectional view of the setting tool shown in FIG. 1 in a press-on position thereof.

When the setting tool 10 is pressed against the constructional component U (FIG. 2), the press-on feeler 28 is displaced in direction of arrow 50. The displacement of the press-on feeler 28 is transmitted by the press-on string 25 to the combustion chamber sleeve 12 and the combustion chamber rear wall 14 which are displaced away from the piston guide 17, and the combustion chamber 13 expands, as shown in FIG. 2. Air flows into the combustion chamber 13 through the first openings 15 of the inlet/outlet device 40 until the first openings 15 are closed by a sealing member 29 on the housing 11 in the expanded condition of the combustion chamber 13. The second opening 19 between the combustion chamber sleeve 12 and the piston guide 17 is closed, in the expanded condition of the combustion chamber 13, by a sealing member 27 formed, e.g., as an O-ring and provided on the combustion chamber sleeve 12. The press switch 23 is actuated by the press-on feeler 28 which is formed as a sleeve. Thereby, an actuation signal is transmitted to the control unit 20 by point in time t0. The actuation signal can, e.g., be produced by closing a power circuit. As a result, the control unit 20 is actuated. Further, during the expansion of the combustion chamber 13, fuel flows through a fuel conduit, not shown in the drawings, from the fuel reservoir into the combustion chamber 13. The fuel flow can be controlled electronically or mechanically.

Figure 3:
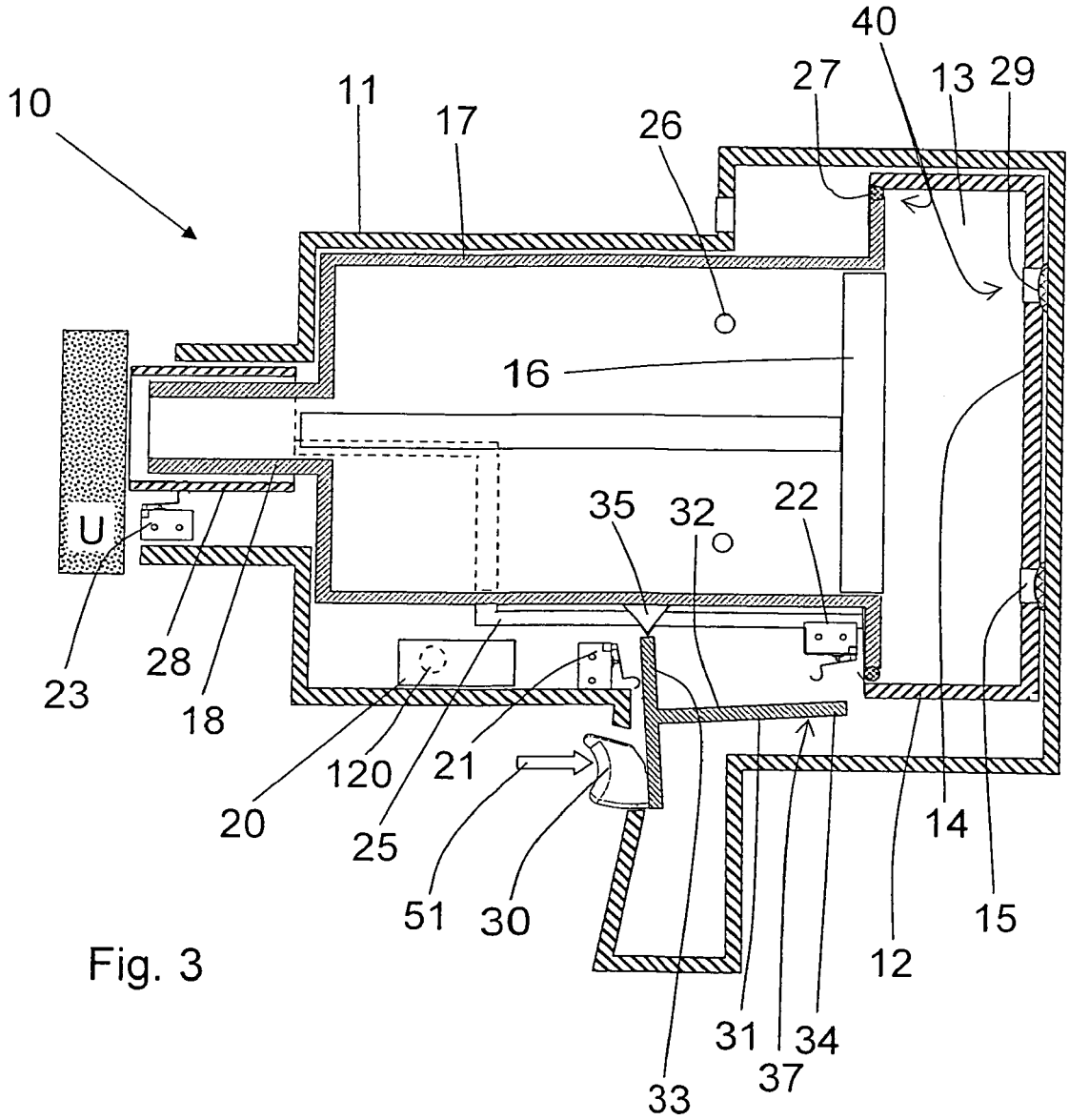
FIG. 3 a longitudinal cross-sectional view of the setting tool shown in FIG. 1 in a press-on position thereof and with the trigger in a first actuating position.

In the position shown in FIG. 3, the trigger 30 is slightly advanced in the direction of arrow 51. As a result, the trigger switch 21 is actuated by a second arm 33 of the switching element 31 and communicates an actuation signal to the control unit 20 by a point in time t1. In response to the actuation signal, the ignition electronics is displaced to its standby position.

Figure 4:
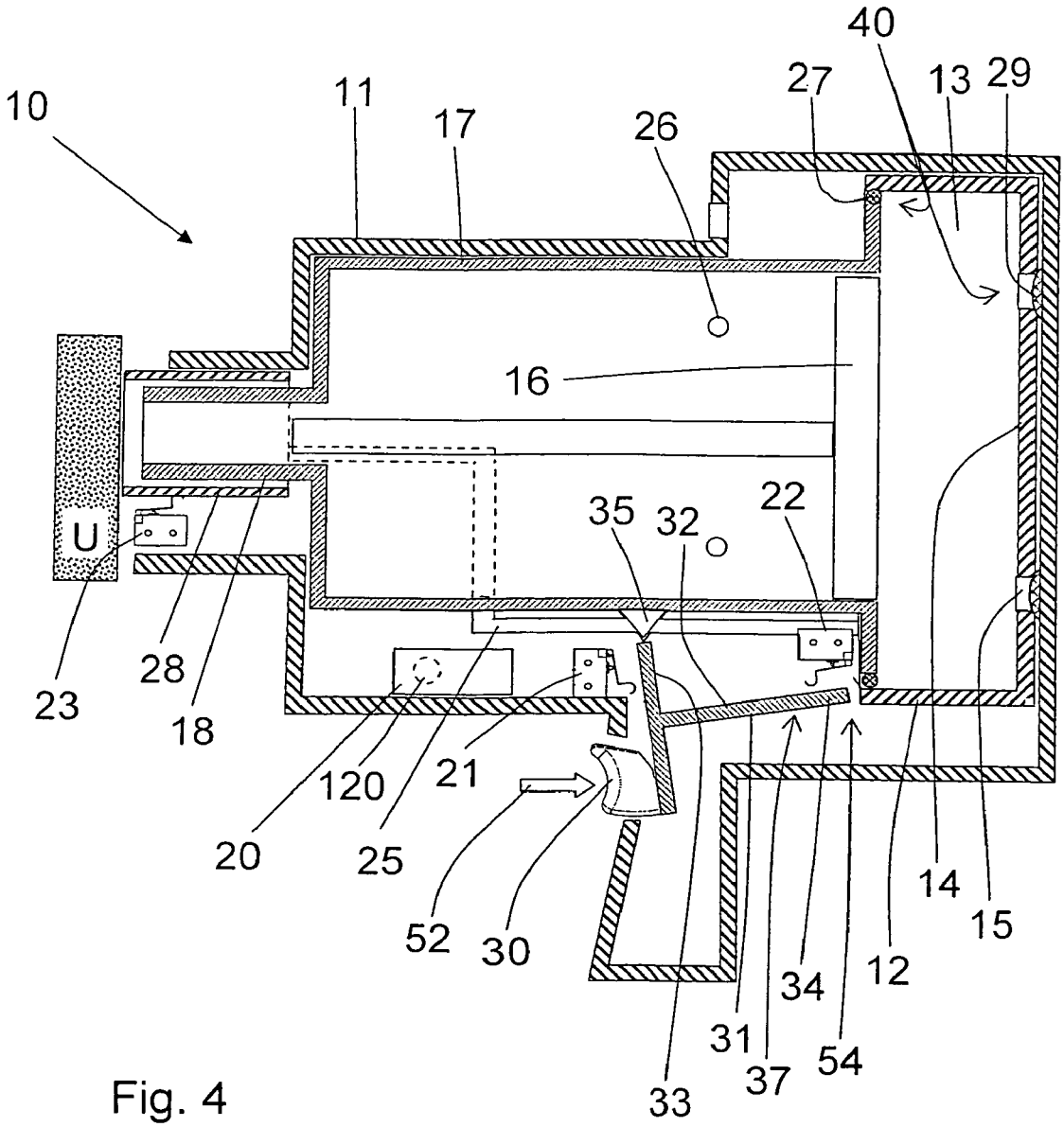
FIG. 4 a longitudinal cross-sectional view of the setting tool shown in FIG. 1 in a press-on position thereof and with the trigger in a second actuating position.

After further displacement of the trigger 30, which is shown in FIG. 4, in direction of arrow 52, a locking member 34 on the switching element 31, which belongs to a locking element generally designated with a reference numeral 37, is displaced into a locking position 54 on the combustion chamber sleeve 12 at a point in time t2. Thereby, the inlet/outlet device 40 is locked in its second position in which the combustion chamber 13 is sealed.

Figure 5:
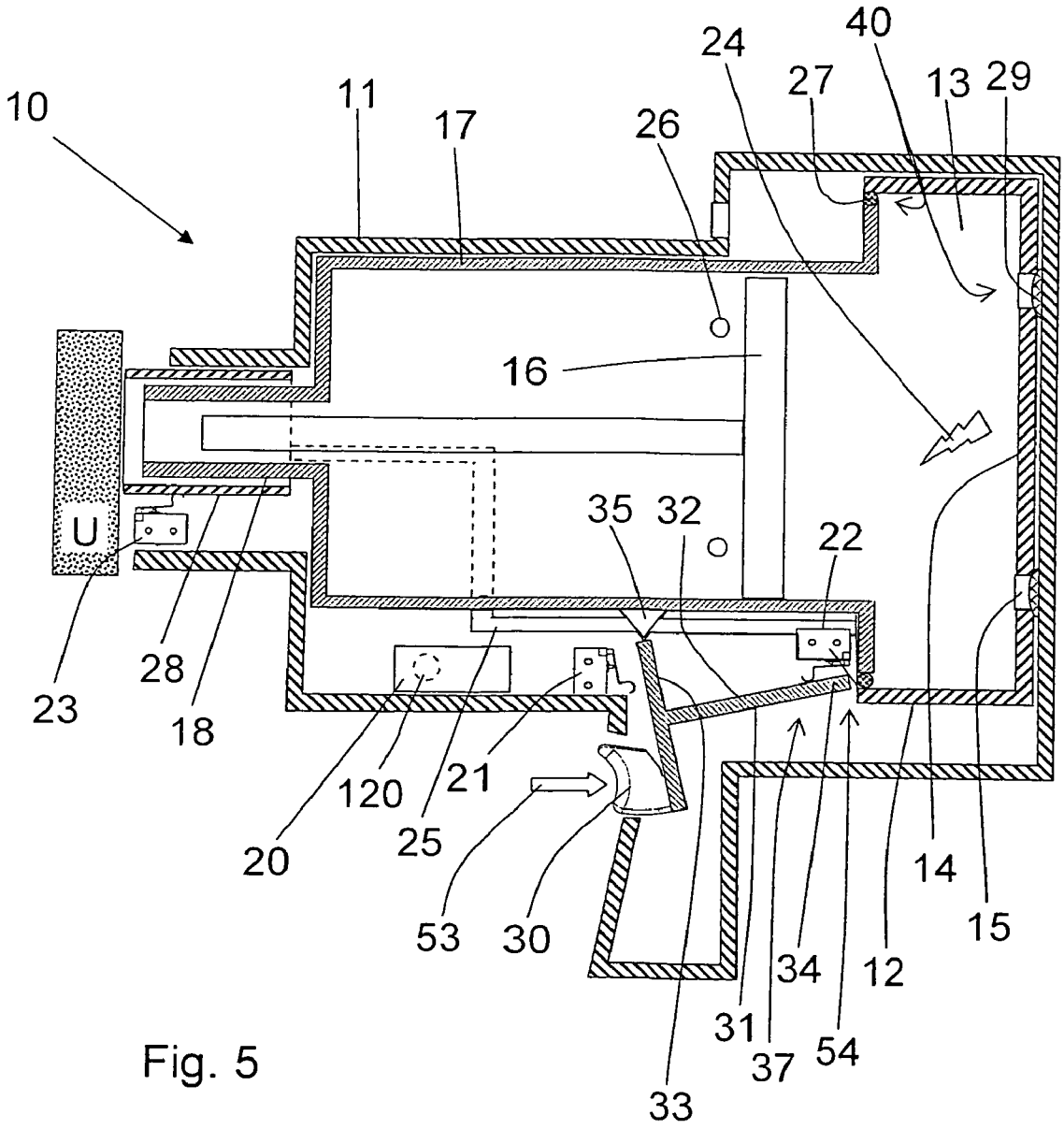
FIG. 5 a longitudinal cross-sectional view of the setting tool shown in FIG. 1 in a press-on position thereof and with the trigger in a completely actuating position.

In the position shown in FIG. 5, the trigger 30 is displaced further in direction of arrow 53 and is completely actuated. The release switch 22 is actuated by the first arm 32 of the switching element 31. The locking member 34 of the switching element 31 remains in its locking position 54 relative to the combustion chamber sleeve 12. The control unit 20 receives an actuation signal for actuating the ignition unit 24 only at a point in time t3.

The ignition 24 would be only initiated by the control unit 20 and a setting process would begin only when one of the following conditions is fulfilled upon inputting actuation signals of the press-switch 23 and the release switch 22 or the trigger switch 21 and release switch 22:

$$t3-t0 \leqq t\max 1 \text{ or } t3-t1 \leqq t\max 2, \text{ wherein}$$

tmax 1 and tmax 2 are predetermined set time periods which are input and stored in the control unit 20 and which have to pass in order for the control unit to actuate another ignition 24. For verification of the first set time tmax 1 and the second set time tmax 2 that should expire between t3 and t0 or t3 and t1, the control unit 120 includes a time comparator 120. When the time comparator 120 determines that the conditions t3−t0≦tmax 1 or t3−t1≦tmax 2 have not been met, the control unit 20 would not initiate any ignition 24. Thereby, a user is prevented from lifting the setting tool 10 of the constructional component and actuating the setting tool after locking the combustion chamber sleeve 12 which functions as a valve.

It is possible to equip the setting tool only with one initialization switch, and to undertake only one set time verification in the setting tool.

The time comparator 120 can, e.g., be formed by a condenser switch, with the set time being determined by discharging or charging time of the switch condenser.

The time comparator 120 can be formed as a computer program running in a microprocessor, with the set time being input and stored in a storage unit and which is retrieved therefrom for comparison with the measured time.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention includes all variations and/or alternative embodiments within the spirit and scope of the present invention as defined by the appended claims.

What is claimed is:

1. A combustion-engined setting tool for driving fastening elements in a constructional component, comprising:

a combustion chamber (13) for combusting a gas mixture;

an inlet/outlet device (40) for opening the combustion chamber (13) and having a first position in which the combustion chamber is open, and a second position in which the combustion chamber (13) is closed, the inlet/outlet device (40) having valve means for reversibly displacing the inlet/outlet device (40) between the first and second positions thereof;

locking means (37) for locking the valve means of the inlet/outlet device (40) in the second position of the inlet/outlet device (40);

a trigger (30) for actuating the locking means (37);

a release switch (22) for triggering ignition in the combustion chamber (13);

an electronic control unit (20) for controlling start of the ignition in the combustion chamber (13), the release switch (22) being connected with the control unit (20); and an initialization switch connected with the control unit (20), the control unit (20) initializing the ignition in the combustion chamber (13) when a time period between switching-on of the initialization switch and switching-on of the release switch (22) does not exceed a predetermined set time period.

2. A setting tool according to claim 1, wherein the initialization switch is formed as a trigger switch (21) that is switchable on dependent on a position of the trigger (30).

3. A setting tool according to claim 2, wherein the trigger (30) has a switching element (31) having a first switch arm (32) for actuating the release switch (22), a second switch arm (33) for actuating the trigger switch (21), and a locking member (34) forming part of the locking means (37).

4. A setting tool according to claim 1, wherein the control unit (20) comprises a time comparator (120) for comparing the time period between switching-on of the initialization switch and the release switch (22) with the set time period.

5. A setting tool according to claim 1, wherein the initialization switch is formed as a press switch (23) that is actuated by a press-on feeler (28) provided in a region of a bolt guide (18) of the setting tool.

* * * * *